US008083457B2

(12) United States Patent
Allen

(10) Patent No.: US 8,083,457 B2
(45) Date of Patent: Dec. 27, 2011

(54) MILL RELINING APPARATUS

(75) Inventor: Ross Clive Allen, Otago (NZ)

(73) Assignee: Russell Mineral Equipment Pty. Ltd., Toowoomba, Queensland (AU)

( * ) Notice: Subject to any disclaimer, the term of this patent is extended or adjusted under 35 U.S.C. 154(b) by 1511 days.

(21) Appl. No.: 10/566,139

(22) PCT Filed: Jul. 23, 2004

(86) PCT No.: PCT/NZ2004/000160

§ 371 (c)(1),
(2), (4) Date: Aug. 7, 2006

(87) PCT Pub. No.: WO2005/009620

PCT Pub. Date: Feb. 3, 2005

(65) Prior Publication Data

US 2006/0283000 A1 Dec. 21, 2006

(30) Foreign Application Priority Data

Jul. 28, 2003 (AU) ..... 2003903868

(51) Int. Cl.
*B65H 1/00* (2006.01)

(52) U.S. Cl. ..... 414/222.01; 414/680; 414/687; 414/688

(58) Field of Classification Search ..... 414/680, 414/687, 688
See application file for complete search history.

(56) References Cited

U.S. PATENT DOCUMENTS 3,540,603 A 11/1970 Neumeler
3,802,150 A 4/1974 Melton et al.
4,205,939 A * 6/1980 Reyes ..... 414/728

FOREIGN PATENT DOCUMENTS

SU 609552 6/1978
SU 1678449 9/1991

* cited by examiner

*Primary Examiner* — Saul Rodriguez
*Assistant Examiner* — Willie Berry, Jr.
(74) *Attorney, Agent, or Firm* — McCarter & English, LLP

(57) ABSTRACT

A mill relining apparatus (1) for handling articles such as liners and lifters within a mill (3). The relining apparatus (1) includes a mast (5), with top (23) and bottom (19) engagement members, which supports one or more article handling arrangements (31) The mast is extendible in length so that it can be locked into a substantially upright position within a mill (3) with the bottom engagement member (19) resting on mill charge (7) within the mill (3) and the top engagement member (23) engaging with an upper surface (99) of the mill (3).

37 Claims, 7 Drawing Sheets

MILL RELINING APPARATUS

FIELD OF THE INVENTION

The present invention relates to a mill relining apparatus. In particular, although not exclusively, the invention may be employed to aid in the handling, removing and/or installing of liners and lifters when relining a sag, ball, or rod mill.

BACKGROUND TO THE INVENTION

Sag, ball and rod mills are used in the minerals industry to grind ore into small particles. Typically, the mills comprise cylindrical-shaped steel milling chambers partially filled with a mill charge or grinding media such as steel balls for sag and ball mills or steel rods for rod mills. A conveyor or hopper moves ore gravel into the mill and the mill is rotated causing the steel balls or rods themselves to cascade, which in turn grinds the ore.

The nature of the intense fracturing and grinding that occurs in the mills requires that the shell of the mill be protected to prevent deterioration. Typically, the protection is achieved by lining the inner wall of the mill shell with plate liners and separate bolted lifters made of hardened steel or combination steel liner/lifter plates may be used.

Depending on the size of the mill, i.e. its diameter and length, there may be well over 100 mill liners and lifters, each typically weighing over 100 kilograms. As the mill is operated, the Intense fracturing and grinding wears the mill liners and lifters, and replacement becomes necessary. The relining process is necessary to maintain the integrity of the mill shell and to improve the efficiency of the mill grinding process by increased material lift from the new lifters and liners.

The relining process involves taking the mill out of service, and sequentially removing the worn liners and lifters and replacing them with new liners and lifters. Typically, liners are retained by lifter bolts through the shell of the mill and these lifter bolts must first be removed before the liners or lifters can be removed from the shell of the mill. To remove a lifter bolt its nut is loosened from the exterior of the mill shell and the lifer bolt is punched through into the mill. Once the lift bolts have been removed, the worn liner and lifter can be removed from the inner wall of the shell and a new liner and lifter can be bolted in place.

It is important that the relining process is undertaken as quickly as possible as any downtime with the mills out of service can be costly and for this reason various handling machines and tools are often used to aid in the relining process. Further, such handling machines and tools are often essential due to the size and weight of the liners and lifters.

One known method of relining a mill involves inserting a into an open end or entry of the mill, for example through the center of the mill's bearing, to form a pathway within the mill along which a handling machine comprising a carriage with a remote handling arm can move. Typically, the carriage's remote handling arm has a grapple assembly or the like for handling mill liners and lifters, and the handling arm is operable to aid in the relining process. Such a device is described in U.S. Pat. No. 3,802,150. Other known handling machines do not use a track within the mill but operate by simply extending a single arm through a large entry point in the mill which can run around the inside of the mill handling and placing liners and lifters.

The handling machines mentioned are suitable for larger mills, for example mills that are 12 meters in diameter, which have large end entry points, for example openings of up to 2 meters in diameter through the mill's end bearing. However, generally these machines can not be used in smaller mills with small entry points or openings. Therefore, the relining process for smaller sized mills conventionally involves removing and replacing liners and lifters by hand. This can be a time consuming and costly operation, not only because of the mill downtime but because a significant amount, of manual labour is required. Further, relining a mill by hand only can be risky to those involved from a safety viewpoint.

It is an object of the present invention to provide an alternative mill relining apparatus.

SUMMARY OF THE INVENTION

In a first aspect, the present invention broadly consists in a mill relining apparatus for handling articles within a mill, including: a mast provided with top and bottom engagement members at its respective ends; and an article handling arrangement supported by the mast, wherein the mast is extendible in length so that it can be locked into a substantially upright position within the mill with the bottom engagement member resting on mill charge within the mill or a lower surface of the mill and the top engagement member engaging with an upper surface of the mill.

In a first preferred embodiment of the mill relining apparatus, the article handling arrangement may include a support framework which is pivotally supported by the mast and a boom which extends from the support framework. Preferably, the mast includes at least one support to which a part of the support framework may be pivotally connected. More preferably, the support(s) of the mast define an axis about which the support framework may pivot relative to the mast and at least one of the supports is configured to be selectively moveable relative to the mast so that the orientation of the pivot axis relative to the mast can be adjusted. For example, the mast may have upper and lower supports each of which may have an aperture and the support framework may have upper and lower engagement members which are configured to engage into a respective aperture of the upper and lower supports. Further, the lower support of the mast may be selectively moveable relative to the mast.

Preferably, the support framework is in the form of a jib which has upper and lower alms and a support member which extends between the upper and lower arms.

Preferably, the support framework has a plurality of connection points, any one of which the boom may be connected to.

Additionally, the mill relining apparatus may include a guy wire which extends between a part of the support framework and a part of the boom to provide additional support for the boom.

Preferably, the boom is extendible in length. More preferably, the boom includes a first member which is connected to the support framework and a second member which is supported by and moveable relative to the fast member. In the preferred embodiment, the first member has an associated roller which engages with the second member and the second member has an associated roller which engages with the first member, the rollers enabling the second member to be moved relative to the first member to adjust the length of the boom.

Preferably, the boom is substantially perpendicular to the mast.

In a second preferred embodiment of the mill relining apparatus, Me article handling arrangement may include a boom which is configured to be pivotable substantially vertically and substantially horizontally relative to the mast. Preferably, the vertical pivotal movement of tee boom relative to the is determined by an operable winching system. More preferably, the winching system includes a cable which extends between a part of the boom and a winch associated with the mast, the winch being operable to wind or unwind the cable to pivot the boom vertically up or down relative to the mast.

Preferably, the boom is extendible in length. More preferably, the boom includes a first member which is supported by the mast and a second member which is supported by and moveable relative to the first member. In the preferred embodiment, the first member has an associated roller which engages with the second member and the second member has an associated roller which engages with the first member, the rollers enabling the second member to be moved relative to the first member to adjust the length of the boom.

The features which follow may relate to either of the first and second preferred embodiments of the mill relining apparatus.

Preferably, a part of the boom is configured with a connection from which articles or auxiliary devices may be supported.

Preferably, the top engagement member provided at an end of the mast may be at least partially formed from a material which is resiliently deformable so that it can securely engage with an upper surface of the mill.

Preferably, the bottom engagement member provided at an end of the mast includes one or more tines which are configured to engage into the mill charge. Alternatively, the bottom engagement member provided at an end of the mast may be at least partially formed from a material which is resiliently deformable so that it can securely engage with a lower surface of the mill.

Additionally, the mill relining apparatus may further include one or more additional article handling arrangements supported by the mast For example, there may be two article handling arrangements supported on opposite sides of the mast.

Preferably, the mast has a base mast part and an extension mast part the extension mast part being movable relative to the base mast part so that the length of the mast can be adjusted. More preferably, a hydraulic system may be coupled to the base mast part and extension mast part and is operable to move the extension mast part relative to the base mast part to alter the length of the mast. Additionally, the hydraulic system preferably includes an accumulator which is configured to maintain the mast at a particular length as desired.

In alternative embodiments of the mill relining apparatus, the article handling arrangement could be any one of the following: a robot handling arm, grapple, or other auxiliary device.

In a third preferred embodiment of the mill relining apparatus, the article handling arrangement may extend from the mast at a fixed angle and the mast may be arranged to be rotatable relative to the top and bottom engagement members so that the article handling arrangement can be moved.

In a second aspect, the present invention broadly consists in an unassembled mill relining apparatus, including: a mast that is extendible in length so that it can be locked into a substantially upright position within a mill; a top engagement member connectable or connected to the top end of the mast for engaging with an upper surface of the mill; a bottom engagement member connectable or connected to the bottom end of the mast for resting on mill charge within the mill or a lower surface of the mill; and an article handling arrangement that is connectable to the mast so that it is supported by the mast.

In a first preferred embodiment of the unassembled mill refining apparatus, the article handling arrangement includes a support framework and a boom which may be extendible in length, the support framework being connectable to the mast and the boom being connectable to the support framework. Additionally, the unassembled mill relining apparatus may flyer include a guy wire which is connectable between a part of the support framework and a part of the boom.

In a second preferred embodiment of the unassembled mill relining apparatus, the article handling arrangement includes a boom which is extendible in length, the boom being connectable to a part of the mast. Additionally, the unassembled mill relining apparatus may firer include an operable winching system which is connectable between a part of the mast and a part of boom.

The features which follow may relate to either of the first and second preferred embodiments of the unassembled mill relining apparatus.

Preferably, the unassembled mill relining apparatus may further include one or more additional article handling arrangements which are connectable to the mast.

Preferably, the mast has a base mast part and an extension mast part which can be coupled together to allow the extension mast part to be movable relative to the base mast part so that the length of the mast can be adjusted. Additionally, the unassembled mill relining apparatus may her include a hydraulic system which may be coupled to the base mast part and extension mast part to facilitate movement of the extension mast part relative to the base mast part to alter the length of the mast.

In a third aspect the present invention broadly consists in a method of handling articles when relining a mill including: providing an extendible mast; resting a bottom engagement member of the mast on mill charge within the mill or a lower surface of the mill; extending the mast so that a top engagement member of the mast engages with an upper surface of the mill to thereby lock the mast in a substantially upright position within the mill; connecting an article handling arrangement to the mast so that it is supported by the mast and operating the article handling arrangement to handle one or more articles within the mill.

Preferably, the top and bottom engagement members are connected to respective ends of the mast prior to resting the bottom engagement member of the mast on mill charge within the mill or a lower surface of the mill. Alternatively, an end of the mist may be connected to the bottom engagement member after the bottom engagement member has been rested on mill charge within the mill or a lower surface of the mill.

Preferably, the method of handling articles when relining a mill further includes connecting two article handling arrangements to the mast and operating the article handling arrangements on opposite sides of the mill to handle one or more articles within the mill.

BRIEF DESCRIPTION OF THE DRAWINGS

Preferred forms of the invention will be described by way of example only and with reference to the drawings, in which.

DETAILED DESCRIPTION OF PREFERRED FORMS

Figure 1:
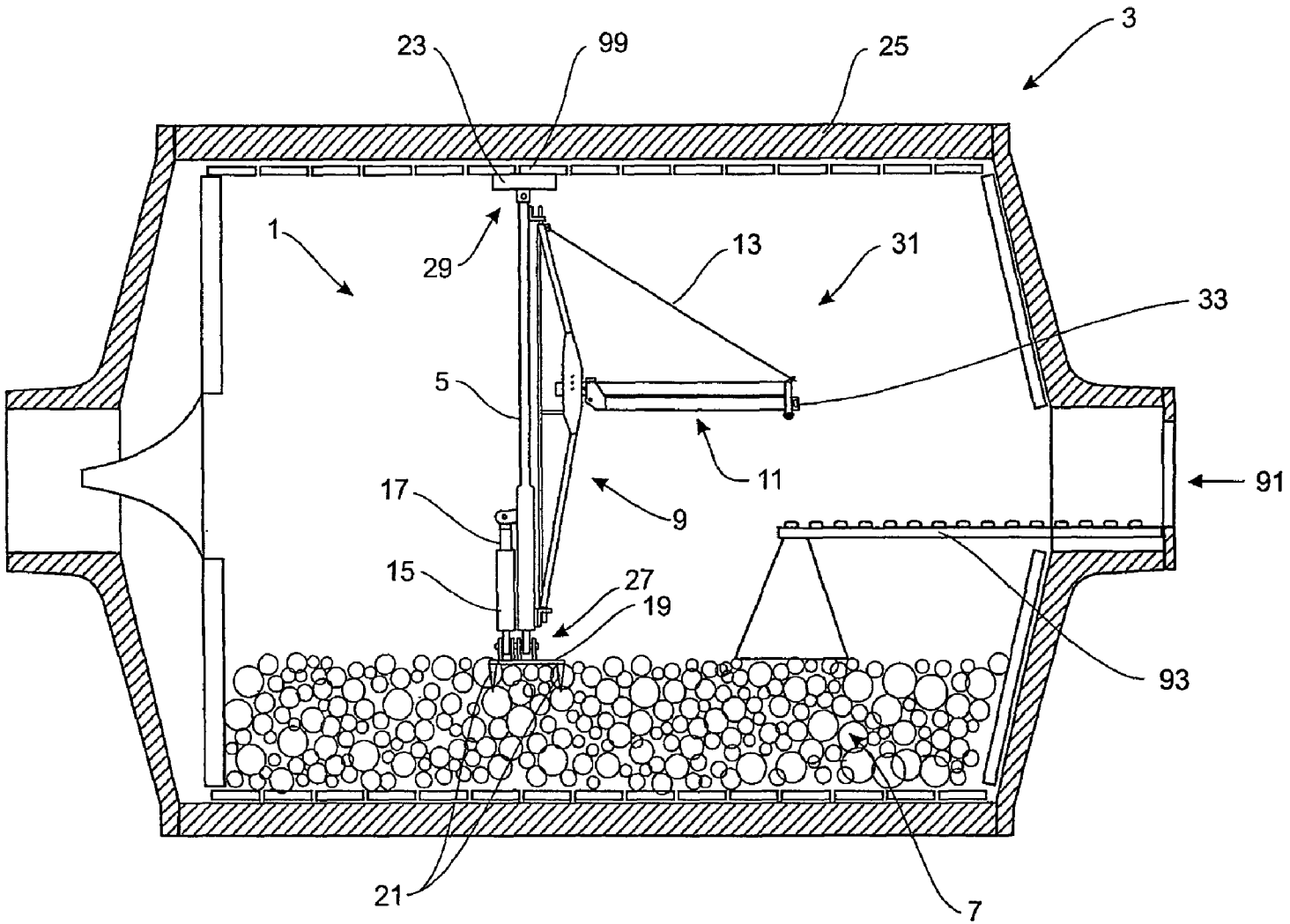
FIG. 1 shows a cross-sectional side elevation view of a mill with a first preferred form mill relining apparatus installed therein.

A mill relining apparatus in accordance with a first preferred form of the present invention will be described with reference to FIGS. 1, 2, and 3. Referring initially to FIG. 1, the first preferred form mill refining apparatus 1 is shown installed within a mill 3. The mill 3 is a ball or sag mill which has a cylindrically-shaped and elongate shell 25 and has a number of steel balls which fill a lower portion of the shell 25, and which constitute the mill charge 7.

The relining apparatus 1 includes a mast 5 which is extendible in length and includes a lower part 27 and upper part 29. The upper part 29 of the mast 5 has a top engagement member 23 and the lower part 27 of the mast 5 has a bottom engagement member 19.

FIG. 1 illustrates the relining apparatus 1 in a filly assembled and installed position within the mill 3. The mast 5 is in a substantially upright position and has been extended in length so that it is locked securely in place within the mill 3 between the mill charge 7 and an upper surface of the mill 3. In particular, the bottom engagement member 19 of the mast 5 rests on and engages into the surface of the mill charge 7 and the mast 5 is locked into a substantially upright position by virtue of an extension of the mast's 5 length so that the top engagement member 23 of the mast 5 engages securely with an upper surface of the mill 3. The upper surface of the mill 3 could be a liner 99 attached to the mill shell 25 as shown in FIGS. 1 and 2, any other article attached to mill shell 25 such as a lifter 4 (shown in FIG. 2), combination liner/lifter or the like, or the surface 10 (shown in FIG. 2) of the inner wall of the mill shell 25.

The relining apparatus 1 includes a hydraulic system (not all components shown) which facilitates extension of the mast's 5 length. The hydraulic system includes a hydraulic cylinder 15 and a hydraulic ram 17 which is moved by the hydraulic cylinder 15. The hydraulic cylinder 15 and ram 17 are coupled to portions of the mast 5 to facilitate its extension.

The relining apparatus 1 includes an article handling arrangement 31 supported by the mast 5 for handling mill liners, lifters, combination liner/lifters and other articles. The article handling arrangement 31 includes a support framework in the form of a jib 9 which is supported by the mast 5 and a boom 11 which is connected to the jib 9. The boom 11 is extendible in length and is provided with a connection 33 at its end distal to the jib 9 to facilitate the loading of articles such as mill liners or lifters, or the connection of auxiliary devices which handle mill liners or lifters. Such auxiliary devices may include pneumatic or hydraulic winches, remote handling arms, grapples and the like.

The article handling arrangement 31 is also provided with a guy wire 13 which extends between an upper end of the jib 9 and a portion of the boom 11. The guy wire 13 provides support for the boom 11, which in use may be loaded up with articles weighing in excess of 100 kilograms.

Figure 2:
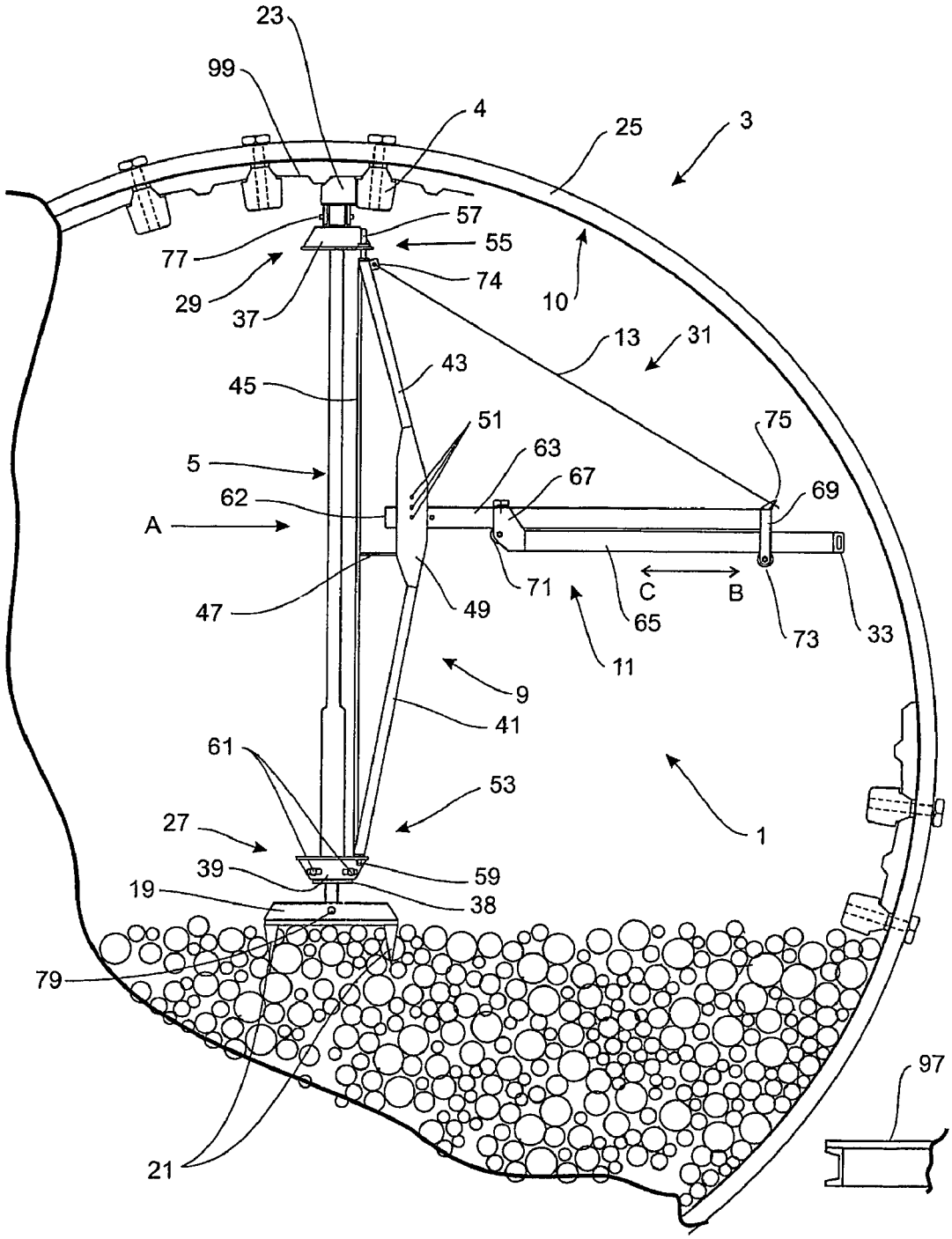
FIG. 2 shows a cross-sectional end elevation view of a mill with the mill relining apparatus of FIG. 1 installed therein.

Referring to FIG. 2, the jib 9 of the article handling arrangement 31 comprises upper 43 and lower 41 arms which are each integrally formed with or attached to a central member 49 to form a wide substantially v-shaped jib 9. The jib 9 also includes a first support member 45 which extends between the upper 43 and lower 41 arms, and a second support member 47 which extends between the first support member 45 and the central member 49.

Upper 57 and lower 59 engagement members are provided at the upper end 55 of the upper arm 43 and lower end 53 of the lower arm 41 of the jib 9 respectively. In the preferred form, the upper 57 and lower 59 engagement members are cylindrical in shape.

The mast 5 is provided with upper 37 and lower 39 supports to which the article handling arrangement 31 engages. In particular, the upper 37 and lower 39 supports have apertures which are configured to receive the upper 57 and lower 59 engagement members of the jib 9 when connecting it to the mast 5. When the jib 9 is connected to the mast 5, the upper 57 and lower 59 engagement members of the jib 9 may pivot within the respective apertures of the upper 37 and lower 39 supports of the mast 5. Ultimately, the apertures of the upper 37 and lower 39 supports define an axis about which the jib 9, and thereby the entire article handling arrangement 31, may pivot. In the preferred form, the relining apparatus 1 is configured to allow the article handling arrangement 31 to pivot 180°, although it will be appreciated that the relining apparatus 1 may be configured with a larger or smaller degree of pivotal freedom if desired.

For safety, it is important that the article handling arrangement 31 be supported by the mast 5 in a substantially plumb upright position. This reduces the likelihood of the article handling arrangement 31 arbitrarily swinging or pivoting under gravity, about the pivot axis defined by the apparatus of the upper 37 and lower 39 supports of the mast 5, when loaded up wit an article such as a liner, lifter or the like.

In the preferred form, the upper support 37 is fixed to the mast 5, while the lower support 39 is moveable relative to the mast 5 so that the article handling arrangement 31 can be aligned into a substantially plumb upright position. In particular, the lower support 39 is slidably mounted via two fastening arrangements 61 to a back plate 38 provided on the mast 5. In the preferred form, the fastening arrangements 61 comprise nut and bolt fasteners. Each nut and bolt fastener 61 is configured so that the bolt of the fastener 61 extends through an aperture (not shown) in the back plate 38 and through a corresponding elongate slot in the lower support 39. The nut of each fastener 61 is threaded onto the end of the bolt and tightened to secure the lower support 39 to the back plate 38.

To align the article handling arrangement 31 into a substantially plumb upright position, the nut of each of the fastening arrangements 61 can be loosened to allow the lower support 39 to slide horizontally relative to the back plate 38 as desired. The extent of slidable movement available is dependent on the length of the slots in the lower support 39. Once the lower support 39 position adjustment is complete, the lower support 39 may be re-secured to the back plate 38 by sufficiently tightening each nut of the fastening arrangements 61.

It will be appreciated that the upper support 37 may also be configured for movement relative to the mast 5 in other forms. Further, one or more additional fixed or moveable supports may be provided on the mast 5 to support the article handling arrangement 31 or alternatively only one support may be needed in other configurations of the relining apparatus.

As mentioned, the article handling arrangement 31 includes a boom 11 which is connected to the jib 9. In the preferred form, the longitudinal axis of the boom 11 is substantially perpendicular to the axis of the mast 5 and the length of the boom 11 is extendible.

The boom 11 includes first 63 and second 65 members. The first member 63 extends from the jib 9 and supports the second member 65 which is moveable relative to the first member 63 to facilitate the extension of the boom 11. In the preferred form, one end of the first member 63 is connected to the central member 49 of the jib 9 by a fastening arrangement, such as a nut and bolt. In particular, an end 62 of the first member 63 extends through an aperture in the central member 49 and is fixed in place at one of a plurality of connection points 51 by a fastening arrangement. The plurality of connection points 51 are provided on the central member 49 to enable the overall height of the boom 11 above the mill charge 7 to be adjustable.

In the preferred form, the second member 65 is supported by a guide member 69 of the first member 63 through which an end of it extends. The other end of the second member 65 has a slidable connection 67 which couples it to the first member 63. Both the guide member 69 of the first member 63 and slidable connection 67 of the second member 65 are configured with rollers, 73 and 71 respectively. The rollers 73 and 71 facilitate the movement of the second member 65 relative to the first member 63 to enable the length of the boom 11 to be extended or reduced as required. For example, the second member 65 may be moved in direction B relative to the first member 63 to extend the length of the boom 11 or direction C to reduce the length of the boom 11.

While the first member 63 is shown to be above the second member 65, this is not a requirement. For example, in other forms the first member 63 may be located under the second member 65, or both members 63,65 could be side by side. Further, it will be appreciated that there are other ways of providing a boom which is adjustable in length. For example, the boom could include two or more parts configured in a telescopic arrangement and the length of the boom could be adjusted either manually or via a powered means such as a pneumatic, hydraulic, or electric based system. Alternatively, the boom may have two or more parts that are configured to move relative to each other via a gearing system which is manually operable to adjust the length of the boom. It will also be appreciated that the boom does not necessarily have to be extendible in length in other configurations of the relining apparatus.

A connection 33 is provided at the end of the second member 65 which is opposite to the end with the slidable connection 67. The connection 33 can be configured to load liners and lifters, or can be adapted to support other auxiliary equipment which is capable of handling and/or placing liners and lifters. For example, the connection 33 may comprise an aperture to which a loading cable or auxiliary equipment could be attached to or hooked onto.

To provide additional support and strength to the article handling arrangement 31, a guy wire 13 is connected between a connection point 74 formed near the top of the upper arm 43 of the jib 9 and a connection point 75 near the guide member 69 of the first member 63 of the boom 11. The length of the guy wire 13, or its tension, may be adjusted to ensure the boom 11 is level. The guy wire 13 could be a cable, rope, chain or the like.

As mentioned above, the upper part 29 of the mast 5 has a top engagement member 23 and the lower part 27 of the mast 5 has a bottom engagement member 19. In the preferred form shown, the top 23 and bottom 19 engagement members are connected to the upper 29 and lower 27 parts of the mast 5 respectively via fastening arrangements 77,79, for example nut and bolt arrangements. Alternatively, the top 23 and bottom 19 engagement members may be fixed to the mast 5 via other releasable connections or may be permanently fastened to the mast 5 by welding or the like.

The preferred form top engagement member 23 is formed at least partially from a material which is resiliently deformable to engage securely with an upper surface of the mill 3, which could be for example a mill liner 99 as shown. The material may be rubber or the like. In particular, the preferred form top engagement member 23 is a mill rubber lifter, and its position on the upper part of the mast 5 is adjustable. It will be appreciated that the top engagement member 23 may be formed from other types of material and may be shaped differently according to the surface to which it is to be engaged with, for example the surface could be a liner, lifter, or other article attached to the mill shell 25 or alternatively it may be the surface 10 of the inner wall of the mill shell 25.

In the preferred form shown, the bottom engagement member 19 is in the form of a plate which has a plurality of tines 21 protruding from its underside to reduce any movement of the plate 19 with respect to the surface of the mill charge 7. When the plate 19 of the mast 5 rests on the surface of the mill charge 7, the tines 21 extend into the mill charge 7 and reduce the likelihood that the plate 19 will slip or slide along the surface of the mill charge 7. The tines 21 have spiked ends to facilitate their insertion into the mill charge 7. In the preferred form the plate 19 is square and has a tine 21 in each of its four corners.

Figure 3:
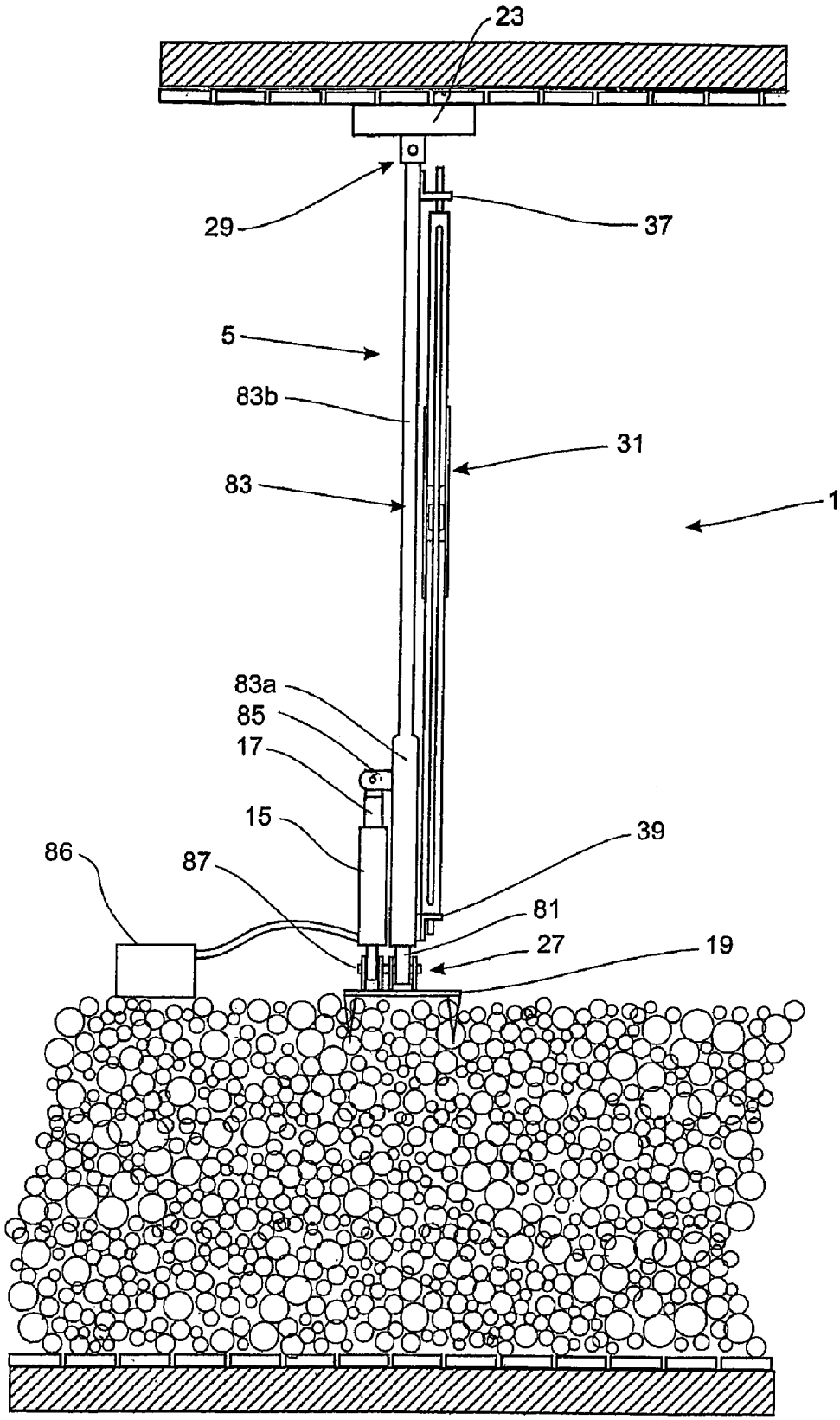
FIG. 3 shows an elevation view of the first preferred form mill relining apparatus from direction A of FIG. 2.

Referring to FIG. 3, the preferred form mast 5 of the relining apparatus 1 comprises two parts, a base mast part 81 and an extension mast part 83. The base mast part 81 is attached at one end to the bottom engagement member 19 and the extension mast part 83 is connected at one end to the top engagement member 23.

The upper support 37 to which an end of the jib 9 engages is provided near the top end of the extension mast part 83, while the lower support 39 to which the other end of the jib 9 engages is provided near the bottom end of the extension mast part 83. In the preferred form, the extension mast part 83 is substantially longer than the base mast part 81 and both parts are substantially square in cross-section, although it will be appreciated that circular or rectangular cross-sectional components would be suitable also.

A portion of the base mast part 5 forms the lower part 27 of the mast 5 and a portion of the extension mast part 83 forms the upper part 29 of the mast 5. The extension mast part 83 includes an enlarged base portion 83*a* integrally formed with or attached to a longer upper portion 83*b* of reduced cross-sectional area relative to the enlarged base portion 83*a*.

The enlarged base portion 83*a* of the extension mast part 83 essentially forms a sleeve into which a portion of the base mast part 81 may extend and the arrangement is such that slidable movement of the extension mast part 83 relative to the base mast part 81 is enabled. It will be appreciated that alternative mast 5 configurations could be used, for example the base mast part 81 may have a sleeve portion into which a portion of the extension mast part 83 may extend to form a slidable arrangement or other mechanisms or configurations may be utilised to enable the parts 81,83 to move relative to each other to provide an extendible mast 5.

As mentioned above, the relining apparatus 1 may include a hydraulic system (not all components shown) to control and power the slidable movement of the extension mast part 83 relative to the base mast part 81, thereby controlling the length of the mast 5. The hydraulic system includes a hydraulic cylinder 15 which is attached to the bottom engagement member 19 and is coupled by a connection 87 to the base mast part 81. A hydraulic ram 17, which is movable within the hydraulic cylinder 15, is coupled by a connection 85 to the enlarged base portion 83*a* of the extension mast part 83.

With the mast 5 parts coupled to the elements of the hydraulic system, extension or retraction of the hydraulic ram 17 from or into the hydraulic cylinder 15 causes a corresponding slidable movement of the extension mast part 83 relative to the base mast part 81, hereby enabling the overall length of the mast 5 to be adjusted.

It will be appreciated that an extendible mast 5 may be achieved in other ways, for example the mast may comprise a plurality of segments configured in a telescopic arrangement. Further, the mast length could be adjusted manually or via a powered means. For example, a hydraulic system may be utilised to control the extension of the mast as described, or alternatively a pneumatic or electric based system could be used to adjust the length of the mast.

In the preferred form, the hydraulic system may also include an accumulator 86. The accumulator 86 maintains a substantially constant pressure within the hydraulic cylinder 15 to maintain the mast 5 in an extended and locked substantially upright position within a mill 3 when the relining apparatus 1 is being used to handle and/or place liners or lifters.

In the preferred form, the accumulator 86 consists of a shell which encloses a flexible rubber bladder. The accumulator 86 is connected to the hydraulic line which pumps fluid into the hydraulic cylinder 15. The flexible rubber bladder is precharged to a predetermined pressure with a gas, such as nitrogen. When the hydraulic system forces hydraulic fluid through the shell of the accumulator 86 and into the hydraulic cylinder 15, the gas inside the bladder of the accumulator 86 compresses until the gas pressure becomes equal to the hydraulic system pressure. Should the pressure of the hydraulic fluid within the hydraulic cylinder 15 fall, the bladder expands and forces more fluid into the cylinder, thereby maintaining a constant pressure within the hydraulic cylinder 15. A pressure fall in the hydraulic cylinder may occur, for example, in response to movement of the steel balls of the mill charge 7 or loading of the article handling arrangement 31, either of which may potentially destabilise the mast 5.

It will be appreciated that the hydraulic system could be adapted to suit different requirements, such as different mill sizes or loads. For example, a larger cylinder and ram arrangement may be required for larger mills. Further, the hydraulic system pressure may be adjusted or varied as required to maintain the structural integrity of the relining apparatus during use and may be calibrated for specific mill specifications, mast specifications or loading requirements.

Referring to FIGS. 1-3, a typical installation of the preferred form relining apparatus 1 within a mill 3 will be described. The relining apparatus 1 is transported into the mill 3 in pieces through an opening 91 in the end of the mill 3. Typically, the base mast part 81, extension mast part 83, top engagement member 23, hydraulic cylinder 15 and ram 17 are pre-connected outside the mill 3 and then transferred into the mill as one component. The bottom engagement member 19, jib 9, boom 1, guy wire 13 and remaining hydraulic components are transferred into the mill 3 separately. The unmentioned components will typically be pre-connected to the various major parts before they are transported to within the mill 3. It will be appreciated that the components of the relining apparatus 1 may also be transported into the mill 3 in various other partially assembled configurations as desired. For example, both the top 23 and bottom 19 engagement members could be pre-connected to respective ends of the mast 5 prior to transporting it into the mill. Alternatively, the relining apparatus 1 could be completely unassembled and each component may be transported into the mill 3 individually.

The first stage in assembling and installing the relining apparats 1 within the mill 3 is erecting the mast 5. This involves connecting the mast 5 component, with the pre-connected top engagement member 23 and hydraulic cylinder 15 and ram 17, to the bottom engagement member 19. With the mast 5 component connected to the bottom engagement member 19, the mast 5 may be supported in a substantially upright position by virtue of the bottom engagement member 19 resting on the mill charge 7 with tines 21 extending into the mill charge 7.

With the mast 5 erected, the remainder of the hydraulic system can be installed, which involves connecting hydraulic lines between a hydraulic pump and the hydraulic cylinder 15 and ram 17, and connecting the accumulator 86 to the appropriate hydraulic line. The hydraulic system can then be actuated, thereby pressurising the hydraulic cylinder 15, and accumulator 86, and enabling the length of the mast 5 to be extended until the top engagement member 23 engages securely with an upper surface of the mill 3, for example a liner 99 attached to the top inner wall of the mill shell 25, thereby locking the mast 5 in a substantially upright position within the mill 3. Adjustment of the mast 5 position may be required to ensure it is plumb. Once the mast 5 is suitably extended and adjusted, the hydraulic fluid line to the hydraulic cylinder 15 can be locked off. The accumulator 86 then maintains a constant pressure within the hydraulic cylinder 15 to keep the mast 5 locked in position.

With the mast 5 locked in a substantially upright position, the jib 9 may be fitted to the upper 37 and lower 39 supports of the extension mast part 83. Adjustment of the lower support 39 is then undertaken to fix the jib 9 in a plumb position to reduce the likelihood that the jib will arbitrarily swing or pivot under gravity. The boom 11 can then be fitted to the jib 9 at one of the connection points 51 of the central member 49 of the jib 9. To finish the assembly, the guy wire 13 is connected between the jib 9 and boom 11. The length of or tension on the guy wire 13 is adjusted to ensure the boom 11 is level.

The installed and assembled relining apparatus 1 can then be utilised to handle and/or place mill liners or lifters within the mill during a relining process. Typically, a hydraulic or pneumatic winch would be connected to the connection 33 of the boom 11 and the winch would be used to load the boom 11 with an article, for example a liner or lifter. Other auxiliary devices may be connected to the boom 11 such as remote handling arms, grapples and the like.

Once the boom 11 has been loaded with an article or articles, the article handling arrangement 31 may be moved to position the article(s) within the mill 3 as desired. The article(s) may be moved by pivoting or swinging the article handling arrangement 31 about the upper 37 and lower 39 supports of the mast 5 or by extending or retracting the boom 11, or a combination of the two. In the preferred form, the article handling arrangement 31 has a degree of pivotal freedom of approximately 180°. Further, if a winch is adapted to the connection 33 of the boom 11, this may be used to alter the height of the loaded article(s). With these ranges of motion, there is significant freedom to place, hold and suspend articles at various locations within the mill 3. For example, if a worn liner were being replaced, the relining apparatus could be utilised to suspend the new replacement liner in place while it was securely bolted to the mill's shell.

Typically, the mill 3 will have to be rotated during the relining process to provide access to all the worn liners and lifters. The relining apparatus 1 would generally be disassembled and removed from the mill 3 before it is rotated and then taken back in and reassembled after rotation, although it is possible to rotate the mill 3 slightly without disassembling the relining apparatus 1. Alternatively, it will be appreciated that the relining apparatus 1 may be partly disassembled and left within the mill, for example resting on the mill charge 7, during rotations of the mill 3.

Typically, the relining apparatus 1 would be used in combination with an endless conveyor 93 which extends into the mill 3 via a center bearing opening 91 of the mill 3. The conveyor 93 could be used to transport new liner and lifters to within the mill, where they could then be loaded onto the relining apparatus 1 and moved around the mill as required. The relining apparatus 1 could also be used to aid in transferring worn liner and lifters from their positions within the mill 3 to the conveyor 93, where they could then be removed from the mill 3.

As shown in FIG. 2, a moveable platform 97, which operates externally to the mill 3, would also typically be used in the relining process along with the relining apparatus 1 to enable an operator to remove and install lifter bolts as required.

It will be appreciated that the pivoting of the article handling arrangement 31 relative to the mast 5 and the extension of the boom 11 may be powered, for example with electric motors, pneumatics, or hydraulics. Further, the relining apparatus 1 may include an overall control system, which is remote or wired to the relining apparatus 1, and which can control various aspects of the relining apparatus 1, for example the boom 11 extension, mast 5 extension, article handling arrangement 31 pivoting, and control of any winch loading mechanism or other auxiliary equipment connected to the boom 11.

It will be appreciated that the relining apparatus 1 could be configured to be installed and used within a mill which does not contain a mill charge. In these circumstances, the bottom engagement member of the mast would simply rest on or engage with a lower surface of the mill. The lower surface of the mill could be a liner, lifter or any other article attached to the mill shell or alternatively the surface of the inner wall of the mill shell. Without any mill charge the bottom engagement member of the mast would not require tines and could be formed in a similar manner to the top engagement member 23. For example, the bottom engagement member could be at least partially formed from a material which is resiliently deformable so that it can securely engage with a lower surface of the mill. The material could be rubber or the like. As with the top engagement member 23, the bottom engagement member could be a mill rubber lifter or could be formed from some other type of material or materials.

Figure 4:
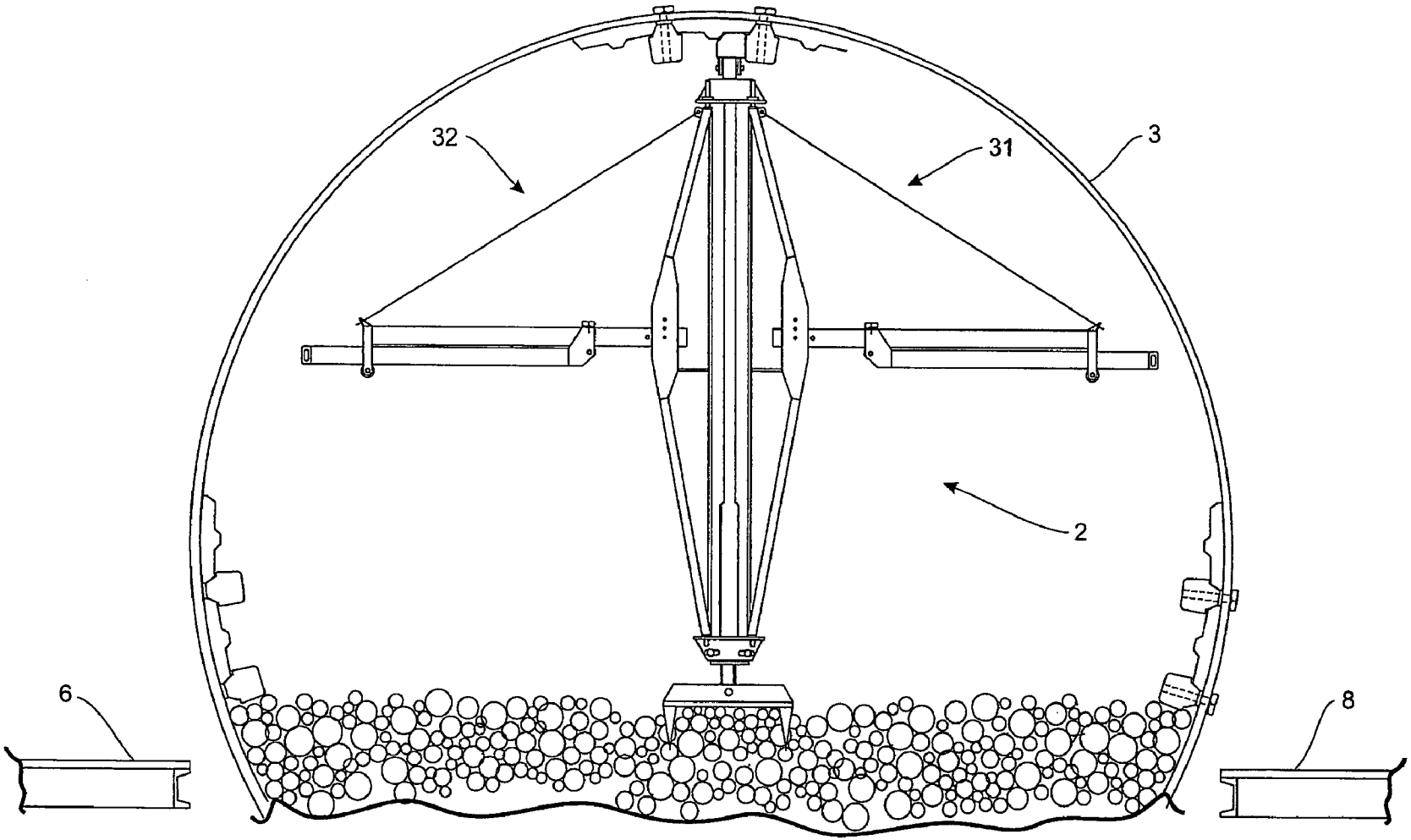
FIG. 4 shows a cross-sectional end elevation view of a mill with a second preferred form mill relining apparatus, which has two article handling arrangements, installed therein.

Referring to FIG. 4, a mill relining apparatus 2 in accordance with a second preferred form of the present invention is depicted. In this form the mast 5 is configured with two article handling arrangements 31, 32 which are situated on opposite sides of the mast 5. This allows the relining apparatus 2 to be utilised on both sides of the mill 3 at once to increase efficiency. Other than the additional article handling arrangement 32, the relining apparatus 2 embodies substantially all of the same features as outlined in respect of the first preferred form apparatus.

Typically, when using the relining apparatus 2 of the second preferred form to work on both sides of a mill 3, one article handling arrangement is used to both remove and replace worn liners and lifters on one side of the mill 3, while the other article handling arrangement is used to only remove worn lifters and liners on the other side of the mill 3. This process will depend on which way the mill 3 is rotated to expose more worn liners and lifters. For example, assuming that the mill 3 is rotated clockwise, article handling arrangement 31 would be utilised to both remove and replace liners and lifters on the right side of the mill 3, while article handling arrangement 32 would be utilised to only remove liners and lifters on the left side of the mill 3. This process is generally utilised because the orientation of the mill 3 would make it difficult to also replace liners and lifters on the left side due to their weight. During rotation of the mill 3, the relining apparatus 2 is disassembled and removed from the mill 3. Once the mill 3 is rotated a certain amount, for example to expose a further 3 liners, the relining apparatus 2 needs to be reassembled within the mill 3.

Moveable platforms 6 and 8 on the left and right sides of the mill 3 respectively would also typically be utilised to aid in the removal of lifter bolts.

Figure 5:
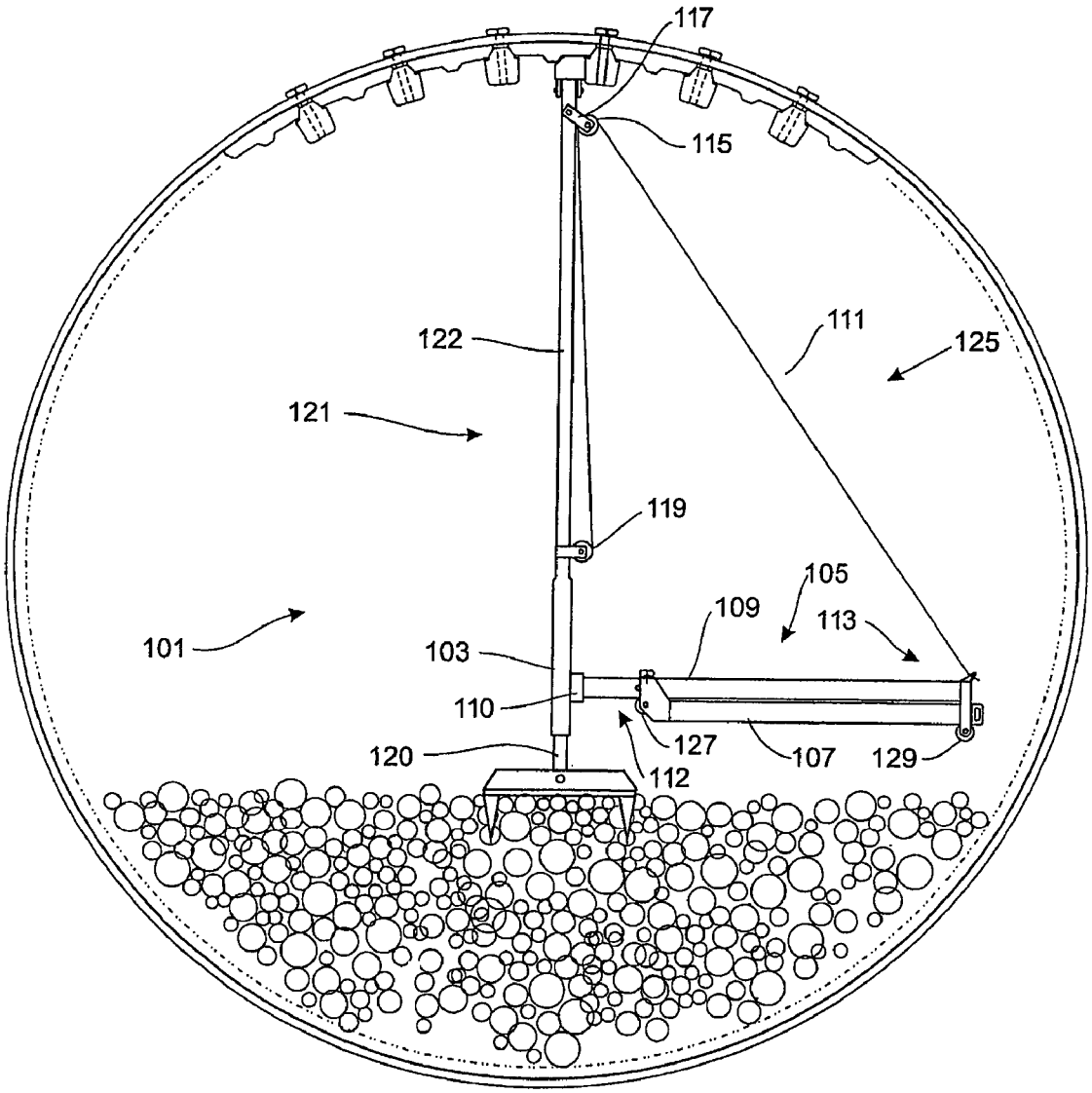
FIG. 5 shows a cross-sectional end elevation view of a mill with a third preferred form mill refining apparatus having a pivotal boom installed therein.

Referring to FIG. 5, a mill relining apparatus 101 in accordance with a third preferred form of the present invention is shown. The third preferred form utilises a different article handling arrangement 125 than that illustrated and described in the first and second forms but essentially the same mast 121 configuration having a base mast part 120 and an extension mast part 122 which are moveable relative to each other via operation of a hydraulic system. In particular, the article handling arrangement 125 includes a boom 105 which is connected to a part of the mast 121 and is configured for pivotal movement relative to the mast 121. It will be appreciated that relining apparatus 101 could also be configured to include any one or more of the features of the first and second form apparatuses disclosed or any alternatives mentioned.

The boom 105 is extendible in length and preferably has first 109 and second 107 members. The second member 107 is configured for movement relative to the first member 109 via rollers 127 and 129 in an arrangement similar to that described in respect of the first and second forms.

In this form, instead of the first member 109 of the boom 105 being connected to a jib, the first member 109 is connected to a support 110 provided at a lower part 103 of the extension mast part 122 of the mast 121. In particular, an end 112 of the first member 109 is engageable with the support 110 to securely connect the boom 105 to the mast 121. Further, the boom 105 and support 110 are configured so that the boom 105 is pivotable either substantially vertically, substantially horizontally or preferably with two degrees of freedom about the support 110 relative to the mast 121. Because of this pivotal arrangement, the boom 105 is supported at the other end 113 of the first member 109 by part of a winching system. In particular, the winching system includes a cable 111 connected to the end 113 of the first member 109 of the boom 105 which then loops around a pulley 115 connected near the top of the mast 121 and down to a winch 119 also connected to the mast 121. The pulley 115 is connected to near the top of the mast 121 by a pivotal connection member 117.

Figure 6:
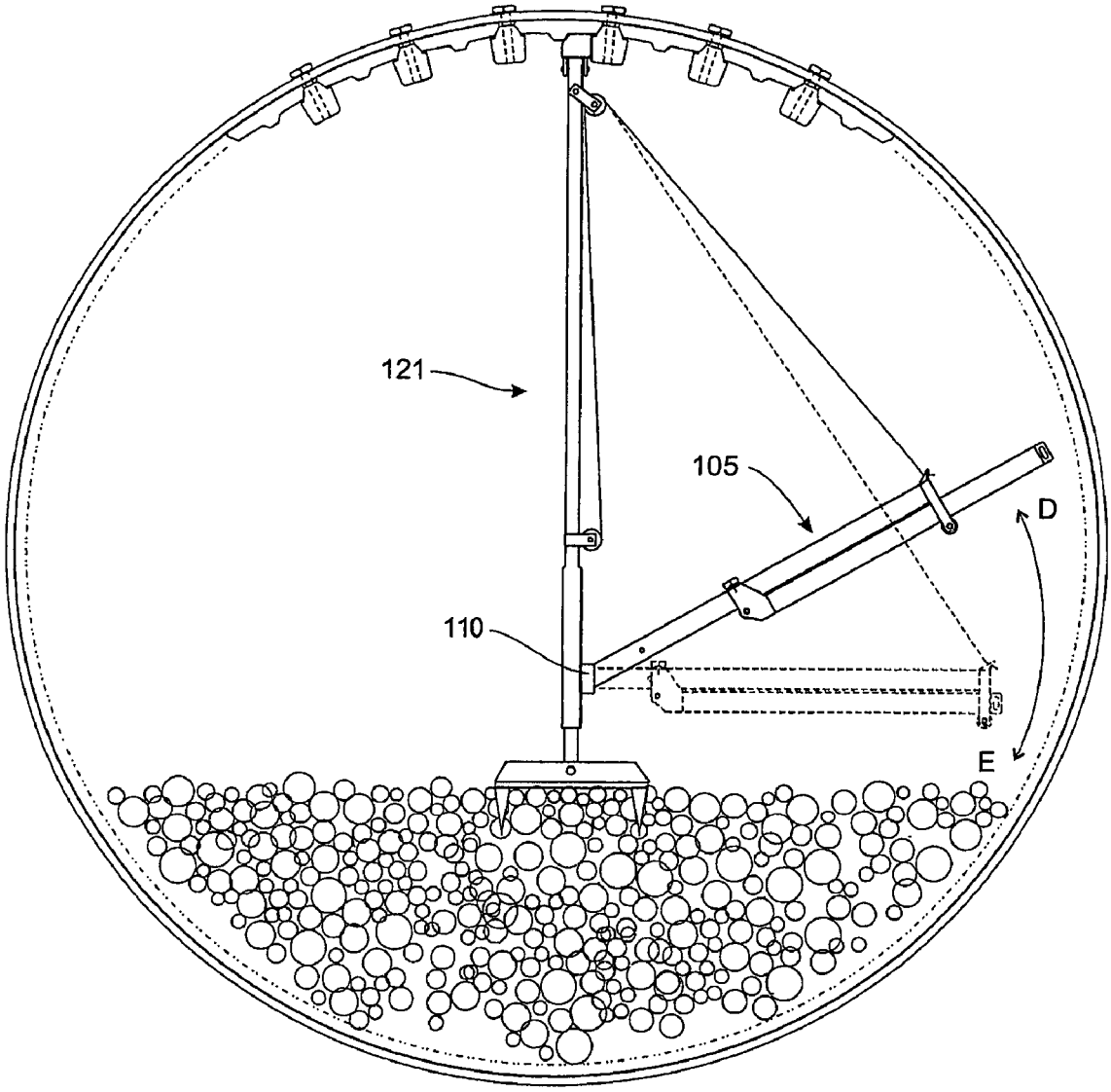
FIG. 6 shows the vertical pivotal movement of the boom of the third preferred form mill relining apparatus of FIG. 5.
Figure 7:
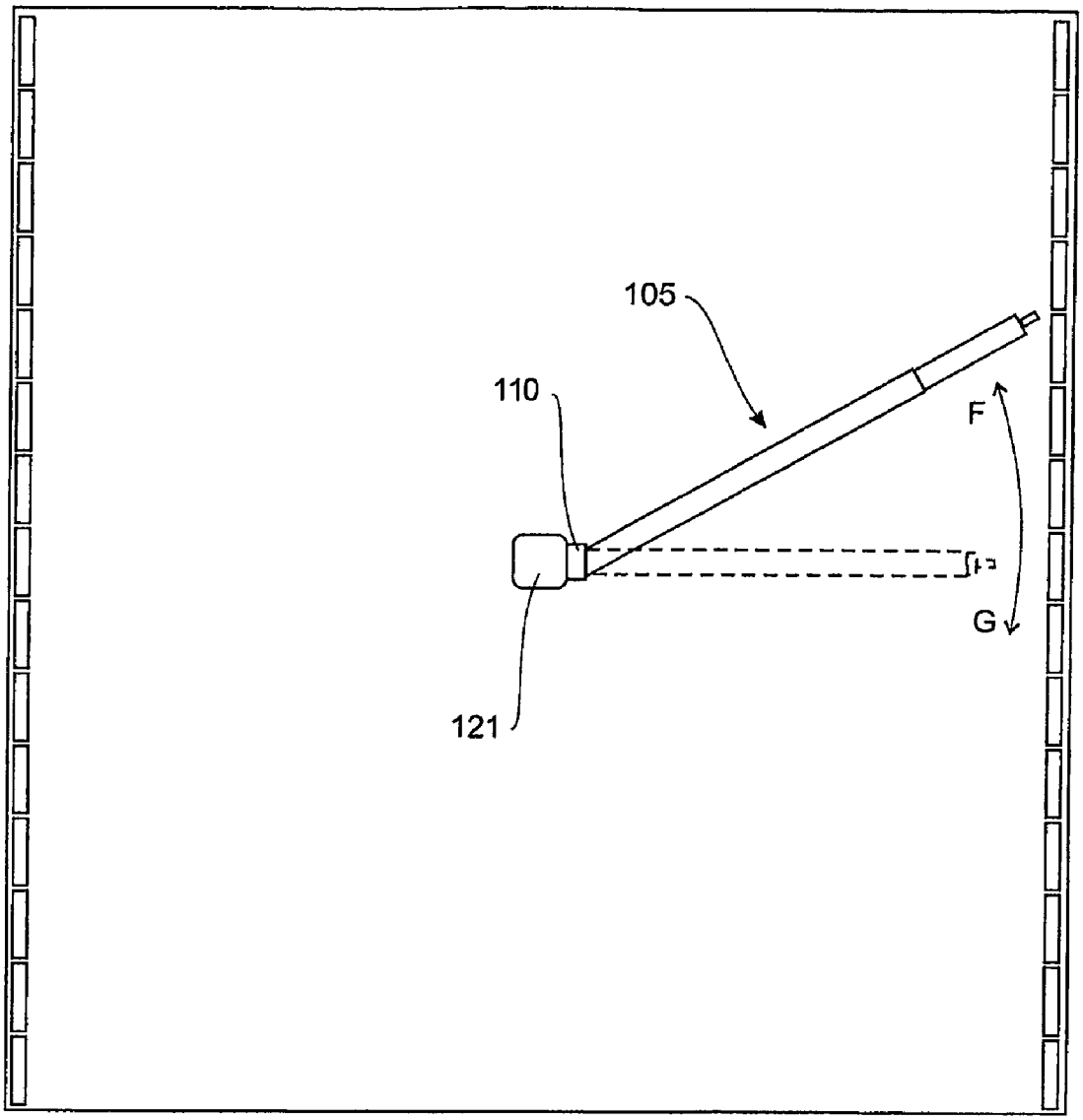
FIG. 7 is a partial cross-sectional plan view of the third preferred form mill relining apparatus of FIG. 5 and shows the horizontal pivotal movement of the boom.

Referring to FIG. 6, the winching system controls the vertical pivotal movement of the boom 105 about support 110 relative to the mast 121. The winch 119 may be operated to wind or unwind the cable 111 to thereby pivot the boom 105 vertically up in direction D or down in direction E about support 110 of the mast 121. Referring to FIG. 7, horizontal pivotal movement of the boom 105 about the support 110 is generally provided manually by a user pushing or pulling the boom 105 horizontally either in direction F or G as required. Therefore, the angle at which the longitudinal axis of the boom 105 extends from the mast 121 may be freely altered as desired. In addition to the pivotal movement, the boom 105 may also be extended to the required length as shown in FIGS. 6 and 7.

The ability to alter the position and orientation of the boom 105 is important when the relining apparatus 101 is used within a smaller mill where space is minimal. It enables workers within the mill to have the option of pivoting the boom 105 vertically lower so that they can step over it or vertically higher so they can step under it, which ever is more suitable to them for the task they are performing in the relining process. Also, the pivotal movement of the boom 105 relative to the mast 121 allows the boom 105 to reach most locations within a mill.

It will be appreciated that various modifications can be made to the relining apparatus 101. For example, powered means such as electrics, pneumatics or hydraulics may be provided to facilitate boom 105 extension. Further, the relining apparatus 11 may include an overall control system, which is remote or wired to the relining apparatus 101, and which can control various aspects of the relining apparatus 101, for example the boom 105 extension, mast 121 extension, operation of the winch 119, and control of any winch loading mechanism or other auxiliary equipment connected to the boom 105 for handling articles. The relining apparatus 101 may also be configured to have more than one article handling arrangements, for example another pivotable and extendible boom may be provided on the opposite side of the mast along with another winching system.

With reference to all three preferred forms described, it will be appreciated that the article handling arrangement(s) do not necessarily have to be pivotable relative to the mast. For example, the article handling arrangement(s) may be configured to extend from the mast at a fixed angle and movement of the article handling arrangement(s) may be provided by the mast which is arranged to rotate relative to its top and bottom engagement members.

It will be appreciated that other article handling arrangements may comprise only booms which are fixed to the mast or alternatively the article handling arrangements do not have to include a boom component. For example, the article handling arrangement may comprise a remote handling arm, grapple or other handling machine which extends directly from the mast. In other alternative forms, the article handling arrangement may comprise a boom which is configured for slidable movement up and down the mast so that the height of the boom can be altered. For example, the boom may be connected to a sleeve which surrounds the mast and is moveable up and down the mast to enable height adjustment of the boom. In addition, the sleeve may be configured to be freely rotatable about the mast so that the boom can be rotated as desired.

While the preferred form mill relining apparatuses have been described in the context of ball and sag mills, it will be appreciated that the relining apparatus of the invention may be installed and used within other mills which utilise other types of mill charge or grinding media. For example, the relining apparatus may be adapted for installation into a rod mill in which steel rods constitute the mill charge. Further, it will be appreciated that the relining apparatus can be utilised in mills which have different mill charge depths.

The mill relining apparatuses of the three foregoing preferred forms may be disassembled so that they can be transferred into a small mill with a relatively small opening, and then reassembled once all the components are inside the mill. For example, the relining apparatus of the first preferred form may be installed within a mill which is about 5.2 meters in diameter, and which has an opening in the end of approximately 0.9 meters in diameter. A mill of this size typically has in the order of 350 liners weighing approximately 115 kilotons each and 214 lifters weighing approximately 145 kilograms each. It will be appreciated that the relining apparatus is fully scalable to suit mills of any size, i.e. large or small.

The relining apparatus of the invention is advantageous in that it enables users to safely handle articles such as liners, lifters and the like within mills and therefore reduces the likelihood of injuries occurring during the relining process.

The foregoing description of the invention includes preferred forms thereof, Modifications may be made thereto without departing from the scope of the invention.

What I claim is:

1. A mill relining apparatus for handling articles within a mill, including:

a mast provided with top and bottom engagement members at its respective ends; and an article handling arrangement supported by the mast, wherein the mast is extendible in length so that it can be locked into a substantially upright position within the mill with the bottom engagement member resting on mill charge within the mill or a lower surface of the mill and the top engagement member engaging with an upper surface of the mill;

wherein the mast has a base mast part and an extension mast part, the extension mast part being movable relative to the base part so that the length of the mast can be adjusted; and wherein a hydraulic system is coupled to the base mast part and extension mast part and is operable to move the extension mast part relative to the base mast part to alter the length of the mast, the hydraulic system including an accumulator which is configured to maintain the mast at a particular length as desired.

2. A mill relining apparatus according to claim 1, wherein the article handling arrangement includes a support framework which is pivotally supported by the mast and a boom which extends from the support framework.

3. A mill relining apparatus according to claim 2, wherein the mast includes at least one support to which a part of the support framework may be pivotally connected.

4. A mill relining apparatus according to claim 3, wherein the support(s) of the mast define an axis about which the support framework may pivot relative to the mast and at least one of the supports is configured to be selectively moveable relative to the mast so that the orientation of the pivot axis relative to the mast can be adjusted.

5. A mill relining apparatus according to claim 4, wherein the mast has upper and lower supports each of which has an aperture and the support framework has upper and lower engagement members which are configured to engage into a respective aperture of the upper and lower supports.

6. A mill relining apparatus according to claim 5, wherein the lower support of the mast is selectively moveable relative to the mast.

7. A mill relining apparatus according to claim 2, wherein the support framework is in the form of a jib which has upper and lower arms and a support member which extends between the upper and lower arms.

8. A mill relining apparatus according to claim 7, wherein the support framework has a plurality of connection points, any one of which the boom may be connected to.

9. A mill relining apparatus according to claim 8, wherein a guy wire extends between a part of the support framework and a part of the boom to provide additional support for the boom.

10. A mill relining apparatus according to claim 9, wherein the boom is extendible in length.

11. A mill relining apparatus according to claim 10, wherein the boom includes a first member which is connected to the support framework and a second member which is supported by and moveable relative to the first member.

12. A mill relining apparatus according to claim 11, wherein the first member has an associated roller which engages with the second member and the second member has an associated roller which engages with the first member, the rollers enabling the second member to be moved relative to the first member to adjust the length of the boom.

13. A mill relining apparatus according to claim 2, wherein the boom is substantially perpendicular to the mast.

14. A mill relining apparatus according to claim 2, wherein a part of the boom is configured with a connection from which articles or auxiliary devices may be supported.

15. A mill relining apparatus according to claim 1, wherein the article handling arrangement includes a boom which is configured to be pivotable substantially vertically and substantially horizontally relative to the mast.

16. A mill relining apparatus according to claim 15, wherein the vertical pivotal movement of the boom relative to the mast is determined by an operable winching system.

17. A mill relining apparatus according to claim 16, wherein the winching system includes a cable which extends between a part of the boom and a winch associated with the mast, the winch being operable to wind or unwind the cable to pivot the boom vertically up or down relative to the mast.

18. A mill relining apparatus according to claim 15, wherein the boom is extendible in length.

19. A mill relining apparatus according to claim 18, wherein the boom includes a first member which is supported by the mast and a second member which is supported by and moveable relative to the first member.

20. A mill relining apparatus according to claim 19, wherein the first member has an associated roller which engages with the second member and the second member has an associated roller which engages with the first member, the rollers enabling the second member to be moved relative to the first member to adjust the length of the boom.

21. A mill relining apparatus according to claim 1, wherein there are one or more additional article handling arrangements supported by the mast.

22. A mill relining apparatus according to claim 21, wherein there are two article handling arrangements supported on opposite sides of the mast.

23. A mill relining apparatus according to claim 1, wherein the article handling arrangement is any one of the following: a robot handling arm, grappler or other auxiliary device.

24. A mill relining apparatus according to claim 1, wherein the article handling arrangement extends from the mast at a fixed angle and the mast is arranged to be rotatable relative to the top and bottom engagement members so that the article handling arrangement can be moved.

25. A mill relining apparatus according to claim 1, wherein the top engagement member provided at an end of the mast is at least partially formed from a material which is resiliently deformable so that it can securely engage with an upper surface of the mill.

26. A mill relining apparatus according to claim 1, wherein the bottom engagement member provided at an end of the mast includes one or more tines which are configured to engage into the mill charge.

27. A mill relining apparatus according to claim 1, wherein the bottom engagement member provided at an end of the mast is at least partially formed from a material which is resiliently deformable so that it can securely engage with a lower surface of the mill.

28. An unassembled mill relining apparatus, including:

a mast that is extendible in length so that it can be locked into a substantially upright position within a mill;

a top engagement member connectable or connected to the top end of the mast for engaging with an upper surface of the mill;

a bottom engagement member connectable or connected to the bottom end of the mast for resting on mill charge within the mill or a lower surface of the mill; and an article handling arrangement that is connectable to the mast so that it is supported by the mast;

wherein the mast has a base mast part and an extension mast part which can be coupled together to allow the extension mast part to be movable relative to the base mast part so that the length of the mast can be adjusted;

wherein a hydraulic system is coupled to the base mast part and extension mast part to facilitate movement of the extension mast part relative to the base mast part to alter the length of the mast, the hydraulic system including an accumulator which is configured to maintain the mast at a particular length as desired.

29. An unassembled mill relining apparatus according to claim 28, wherein the article handling arrangement includes a support framework and a boom which is extendible in length, the support framework being connectable to the mast and the boom being connectable to the support framework.

30. An unassembled mill relining apparatus according to claim 29, further including a guy wire which is connectable between a part of the support framework and a part of the boom.

31. An unassembled mill relining apparatus according to claim 28, wherein the article handling arrangement includes a boom which is extendible in length, the boom being connectable to a part of the mast.

32. An unassembled mill relining apparatus according to claim 31, further including an operable winching system which is connectable between a part of the mast and a part of the boom.

33. An unassembled mill relining apparatus according to claim 28, further including one or more additional article handling arrangements which are connectable to the mast.

34. A method of handling articles when relining a mill including:

providing an extendible mast;

resting a bottom engagement member of the mast on mill charge within the mill or a lower surface of the mill;

extending the mast so that a top engagement member of the mast engages with an upper surface of the mill to thereby lock the mast in a substantially upright position within the mill;

connecting an article handling arrangement to the mast so that it is supported by the mast; and operating the article handling arrangement to handle one or more articles within the mill.

35. A method of handling articles when relining a mill according to claim 34, wherein the top and bottom engagement members are connected-to respective ends of the mast prior to resting the bottom engagement member of the mast on mill charge within mill or a lower surface of the mill.

36. A method of handling articles when relining a mill according to claim 34, wherein an end of the mast is connected to the bottom engagement member after the bottom engagement member has been rested on mill charge within the mill or a lower surface of the mill.

37. A method of handling articles when relining a mill according to claim 34, including connecting two article handling arrangements to the mast and operating the article handling arrangements on opposite sides of the mill to handle one or more articles within the mill.

* * * * *